US010183383B2

(12) United States Patent
Lai

(10) Patent No.: US 10,183,383 B2
(45) Date of Patent: Jan. 22, 2019

(54) RATCHET SCREWDRIVER

(71) Applicant: Jin-Tsai Lai, Taichung (TW)

(72) Inventor: Jin-Tsai Lai, Taichung (TW)

(73) Assignee: Wei Chins Plastic Enterprise Corp., Taichung (TW)

( * ) Notice: Subject to any disclaimer, the term of this patent is extended or adjusted under 35 U.S.C. 154(b) by 136 days.

(21) Appl. No.: 15/346,490

(22) Filed: Nov. 8, 2016

(65) Prior Publication Data

US 2018/0126520 A1 May 10, 2018

(51) Int. Cl.
*B25B 15/04* (2006.01)
*B25B 23/00* (2006.01)

(52) U.S. Cl.
CPC ..... *B25B 15/04* (2013.01); *B25B 23/0007* (2013.01)

(58) Field of Classification Search
CPC ..... B25B 23/0007; B25B 13/468
USPC ..... 81/63.1
See application file for complete search history.

(56) References Cited

U.S. PATENT DOCUMENTS 3,824,881 A * 7/1974 Wright ..... B25B 13/465 81/177.85
7,677,138 B2 * 3/2010 Lin ..... B25B 15/04 81/58.1
7,717,016 B2 * 5/2010 Lai ..... B25B 23/0042 81/177.1
8,408,098 B2 * 4/2013 Hu ..... B25B 13/463 81/177.4
9,108,304 B2 8/2015 Lai
9,550,285 B2 * 1/2017 Lai ..... B25B 23/0035

* cited by examiner

*Primary Examiner* — Hadi Shakeri
(74) *Attorney, Agent, or Firm* — Che-Yang Chen; Law Offices of Scott Warmuth

(57) ABSTRACT

A ratchet screwdriver may include a handle, a shaft and a ratchet switch device. The handle has a passage axially penetrating through a front end thereof, and a mounting member is mounted on an outer periphery of the front end of the handle. Furthermore, a housing slot formed inside a rear portion of the handle is configured to receive the ratchet switch device. The ratchet switch device comprises a base, a switch button, a driving piece, a positioning member, two engaging blocks, two springs, a ratchet and a locating piece, thereby allowing the shaft to independently rotate relative to the handle in a reversed-working direction. Thus, a user has no need to repeatedly detach the ratchet screwdriver from a screw or re-hold the handle when operating, which is more convenient and labor-saving.

6 Claims, 8 Drawing Sheets

B-B

A-A

RATCHET SCREWDRIVER

FIELD OF THE INVENTION

The present invention relates to a screwdriver more particularly to a ratchet screwdriver configured to allow a shaft thereof to rotate individually relative to a handle thereof in a reversed-working direction.

BACKGROUND OF THE INVENTION

Generally, a conventional screwdriver has a shaft and a handle which are firmly connected to each other and each of the shaft and the handle cannot be rotated individually. Thus, my previous invention disclosed in U.S. Pat. No. 9,108,304 provided a ratchet screwdriver which is configured to allow a shaft thereof to rotate individually relative to a handle of the ratchet screwdriver. Wherein the ratchet screwdriver comprises a handle, and a front end of the handle has a mounting member. A passage penetrates through the handle, and a chamber is formed inside a rear end of the handle. A shaft made of metal is inserted into the handle from the front end thereof, and a front end of the shaft has a function end while an insertion end is formed at a rear end of the shaft. A positioning recess formed on the shaft is configured to connect to the mounting member on the handle. A ratchet switch device located in the chamber of the handle has a base, and a room is formed inside the base. Moreover, two first slots are located at two opposite sidewalls of the base, and a recessed area formed at the rear end of the base has multiple notches formed at one side thereof. A through hole formed inside the recessed area is communicated with the room of the base, and a frame located in the room of the base comprises a recess located therein. A central hole penetrates through the frame, and a fastening member extends through the central hole. Each of two ends of the frame has a reception hole and a stop. Two engaging members are connected to two ends of the frame and each has ratchet teeth. Each of the two engaging members has an insertion which is inserted into the reception hole corresponding thereto, and the two engaging members contact the stops of the frame. A positioning member is located in the recess of the frame and the room of the base. The positioning member has a space located therein, and two second slots are located in two opposite walls thereof. A through hole penetrates through the positioning member, and a resilient plate is located inside the space of the positioning member. Each of two ends of the resilient plate has a contact end, and the two engaging members contact the contact ends respectively. Two positioning pieces and a ratchet member are respectively located in the room of the base, and the ratchet member further has ratchet teeth formed in outside thereof so as to be engaging with the ratchet teeth of the two engaging members. The first end of the ratchet member has a hexagonal reception recess into which the insertion end of the shaft is inserted. A tubular part extends from the second end of the ratchet member and extends through the through hole of the positioning member. The tubular part has an annular groove with which a clip is engaged so as to connect the ratchet member with the positioning member. A switch located in the recessed area of the base and connected with the frame has a boss extending therefrom which is engaged with one of the notches.

However, the conventional ratchet screwdriver is disadvantageous because: the ratchet switch device comprises excessive components so as to complicate the structure of the ratchet screwdriver and cause the difficulty in assembly further increasing the manufacturing cost. Moreover, the complicated structure also reduces the efficiency of momentum transfer and lowers the accuracy of operation. Therefore, there remains a need for a new and improved design for a ratchet screwdriver to overcome the problems presented above.

SUMMARY OF THE INVENTION

The present invention provides a ratchet screwdriver, which comprises a handle, a shaft and a ratchet switch device. The handle has a passage axially penetrating through a front end thereof, and a mounting member is mounted on an outer periphery of the front end of the handle. Furthermore, a housing slot formed inside a rear portion of the handle is configured to receive the ratchet switch device. The shaft is made of metal, and an insulated plastic covers around an outer periphery of the shaft to allow a metallic function end of the shaft to protrude from a front end of the plastic. Also, an insertion end is connected to a rear end of the shaft, and a body of the shaft further has a first peripheral groove which is configured to allow the mounting member to engage therewith after the shaft is inserted into the handle through the passage. The ratchet switch device comprises a base, a switch button, a driving piece, a positioning member, two engaging blocks, two springs, a ratchet and a locating piece. The base has a rear wall, and two opposite sidewalls respectively protrude from two opposite edges of the rear wall. The two sidewalls are separated to form a housing chamber, and each of an upper end and a lower end thereof has an evading channel formed between the two sidewalls, and a front end of the housing chamber has a first opening. Two first engaging portions are respectively formed on the two sidewalls at corresponding positions. Moreover, a central portion of the rear wall of the base has a second opening which is communicated with the housing chamber. Each of an upper end and a lower end of the second opening are respectively connected to an elastic first clamping piece, and a lateral edge of the second opening comprises a locating notch. Furthermore, two blocking edges respectively protrude from two lateral edges of the locating notch. The switch button borne against a rear end of the rear wall of the base has a protruding column penetrating through the second opening of the base. Two clamping blocks respectively protrude from an upper edge and a lower edge of the protruding column toward respective first clamping pieces. In addition, an outer periphery of the protruding column has a positioning piece which is located inside the locating notch of the base. The driving piece configured to be received in the housing chamber of the base has two pressing rods protruding from a front surface thereof, and the switch button is connected to the driving piece through the protruding column. The positioning member has a bottom plate, and two lateral plates are respectively connected to two opposite lateral edges of the bottom plate. Two blocking pieces are respectively formed at an upper edge and a lower edge of the bottom plate, and a central hole penetrates through a central portion of the bottom plate. Two axle holes are respectively formed on an upper portion and a lower portion of the bottom plate, and two slot holes respectively formed adjacent to the two axle holes are respectively extended to the two blocking pieces. Each of the two engaging blocks has a row of engaging teeth, and the two engaging teeth are located facing to each other. A supporting axle protrudes from a rear end of the engaging block, and the two supporting axles are configured to insert into the two axle holes of the positioning member respectively. Each of the two springs is formed between the blocking piece and the engaging block. The ratchet has a peripheral ratchet teeth disposed on an outer periphery thereof, and a locating slot formed at a front end of the ratchet is configured to receive the insertion end of the shaft. A protruding piece having a second peripheral groove and protruding from a rear end of the ratchet is configured to penetrate through the central hole of the positioning member, and a second clamping piece is configured to engage with the second peripheral groove of the protruding piece to secure the ratchet with the positioning member. Thus, an assembly of the positioning member, the engaging blocks, the springs and the ratchet is configured to be positioned into the housing chamber of the base through the first opening, and the two pressing rods of the driving piece respectively penetrate through the two slot holes of the positioning member to align with the two engaging blocks. The locating piece has a through hole formed at a central portion thereof, and each of two lateral walls of the locating piece comprises a second engaging portion. The through hole is configured to be penetrated by the ratchet, and with the evading channels, the locating piece is configured to be received in the housing chamber of the base. Moreover, since the two first engaging portions of the base are configured to respectively engage with the two second engaging portions, the locating piece is configured to be firmly secured inside the base. Thus, an assembly of the base, the switch button, the driving piece, the positioning member, the engaging blocks, the springs, the ratchet and the locating piece is configured to be positioned into the housing slot through a rear end of the handle, and the locating slot of the ratchet is configured to receive the insertion end of the shaft.

Comparing with conventional ratchet screwdriver, the present invention is advantageous because: (i) the shaft of the ratchet screwdriver can independently rotate relative to the handle in the reversed-working direction such that a user has no need to repeatedly detach the ratchet screwdriver from a screw or re-hold the handle when operating, which is more convenient and labor-saving; and (ii) the ratchet switch device simplifies the structure of the ratchet screwdriver, wherein the switch button can directly control the pressing rods of the driving piece to press the engaging blocks thereby improving the efficiency of momentum transfer and the accuracy of operation.

DETAILED DESCRIPTION OF THE INVENTION

Figure 1:
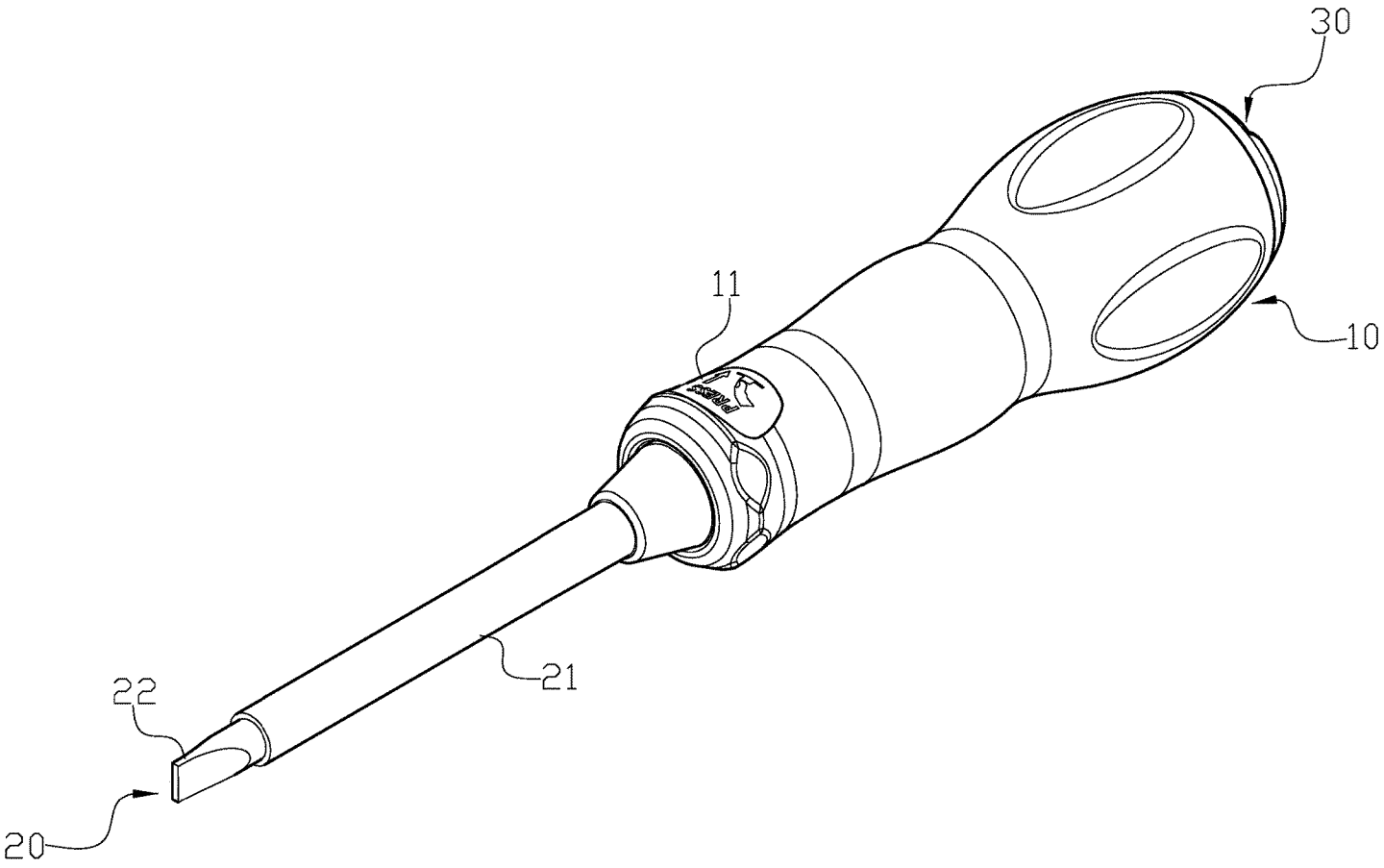
FIG. 1 is a three-dimensional assembly view of a ratchet screwdriver of the present invention.
Figure 2:
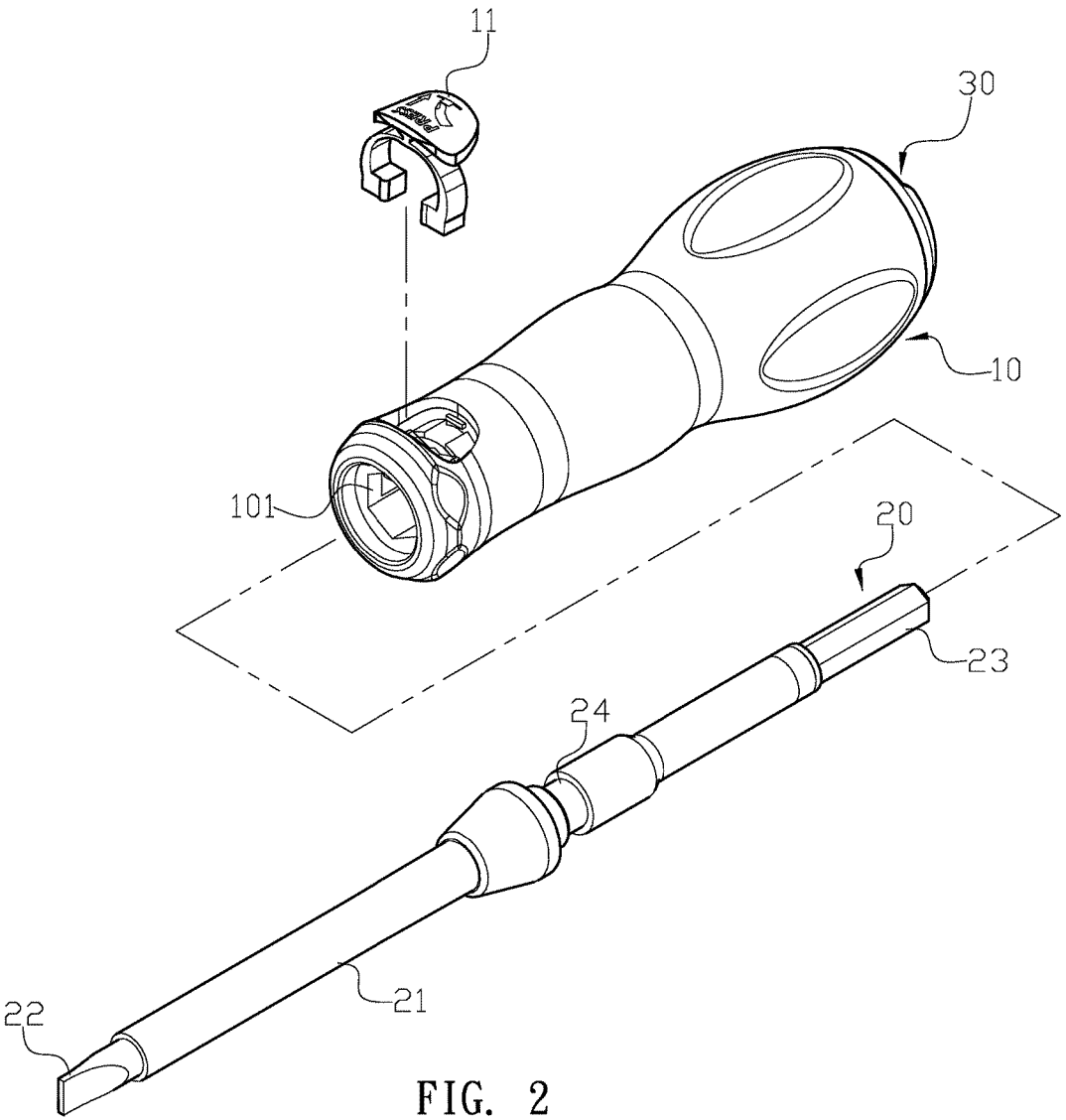
FIG. 2 is a three-dimensional exploded view of the ratchet screwdriver of the present invention.
Figure 3:
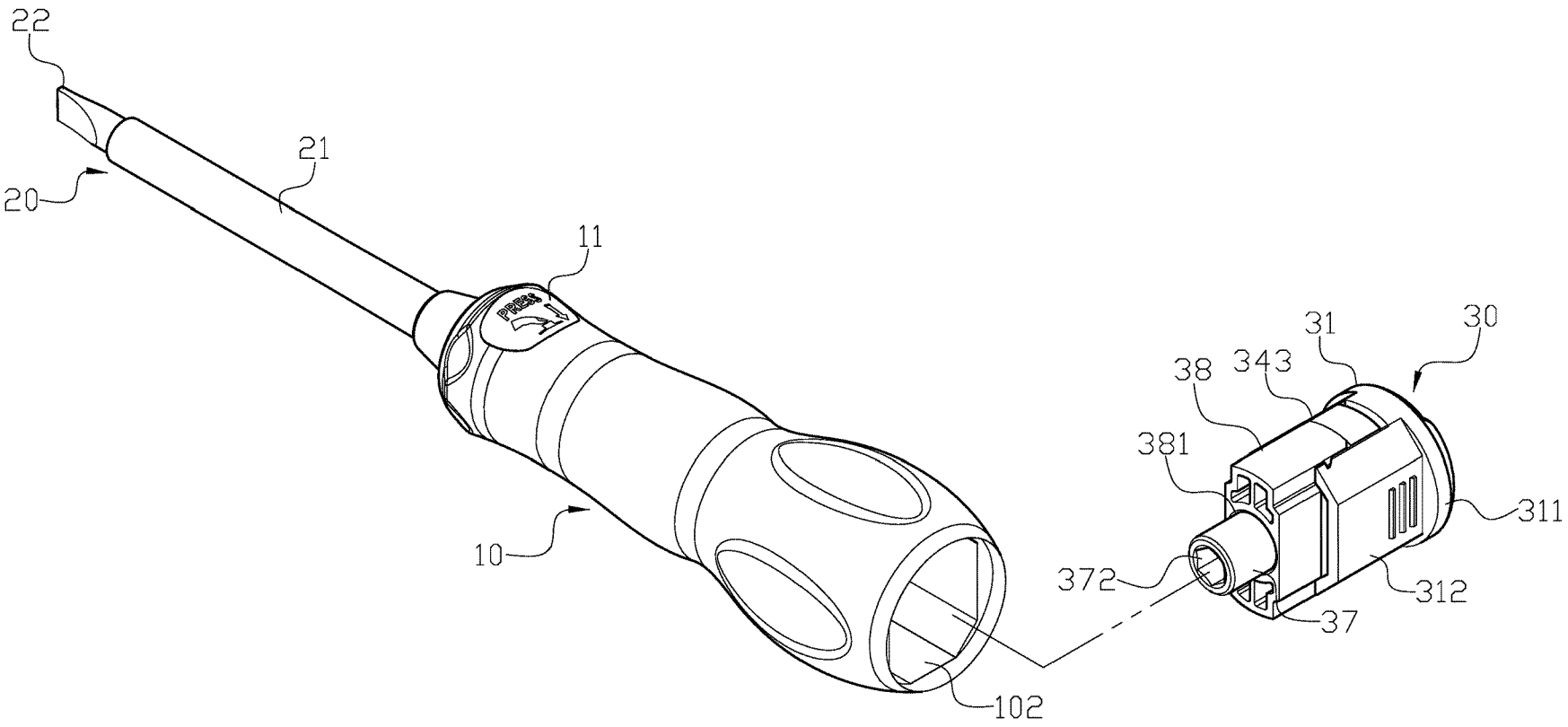
FIG. 3 is a three-dimensional exploded view from another angle of the ratchet screwdriver of the present invention.
Figure 4:
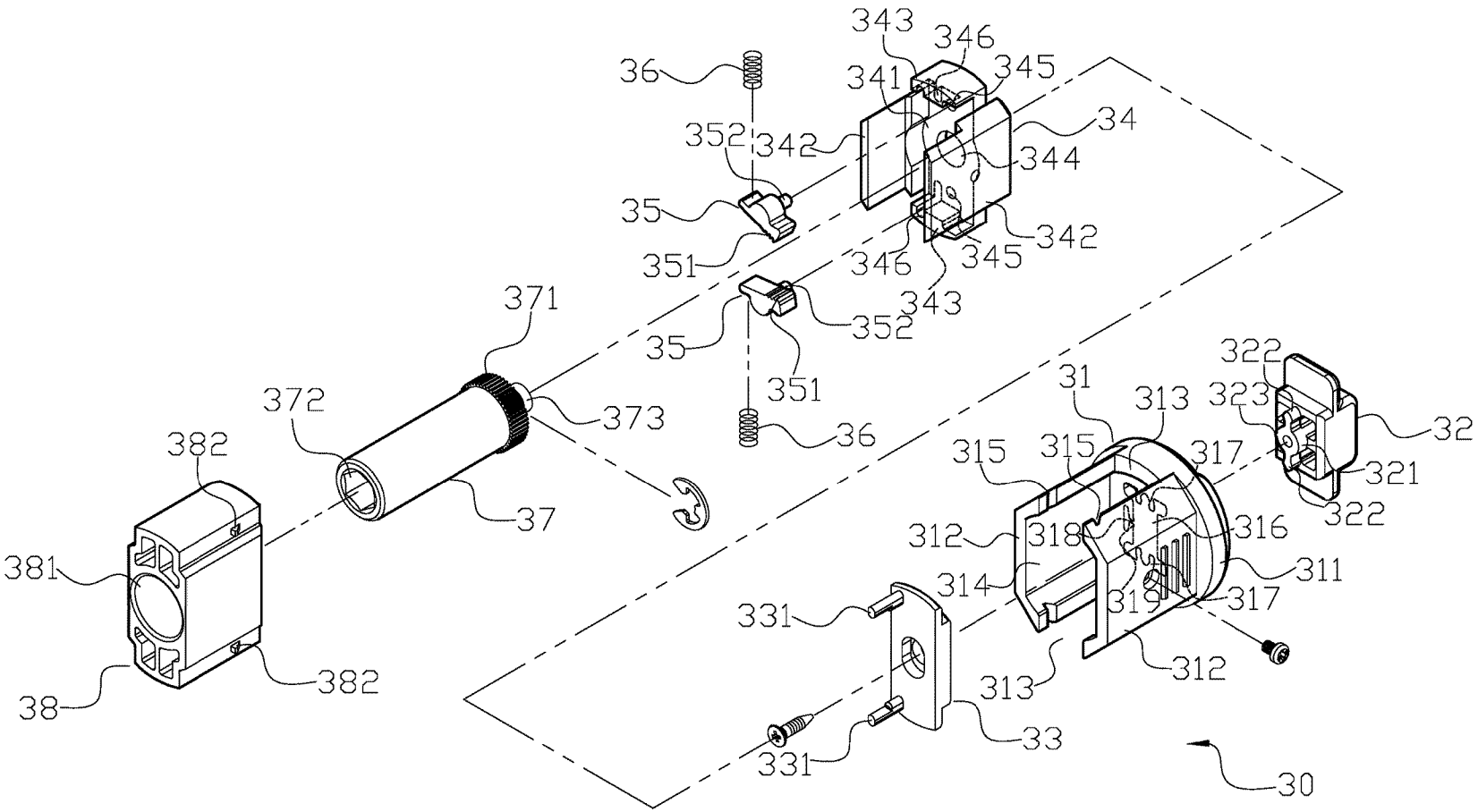
FIG. 4 is a detailed exploded view of the ratchet screwdriver of the present invention.
Figure 5:
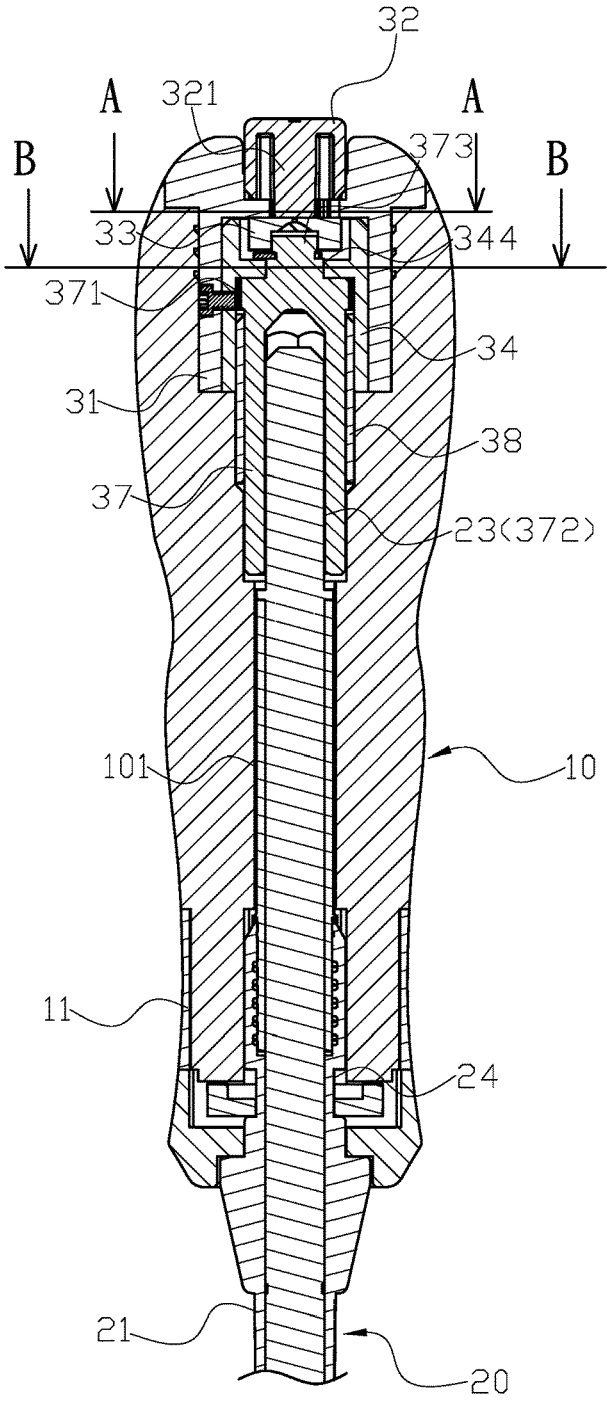
FIG. 5 is a sectional assembly view of the ratchet screwdriver of the present invention.
Figure 7:
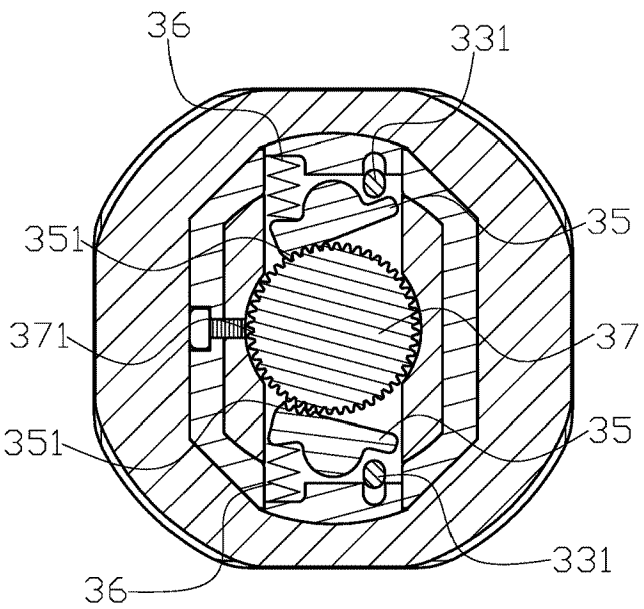
FIG. 7 is a sectional view along B-B of FIG. 5.
Figure 6:
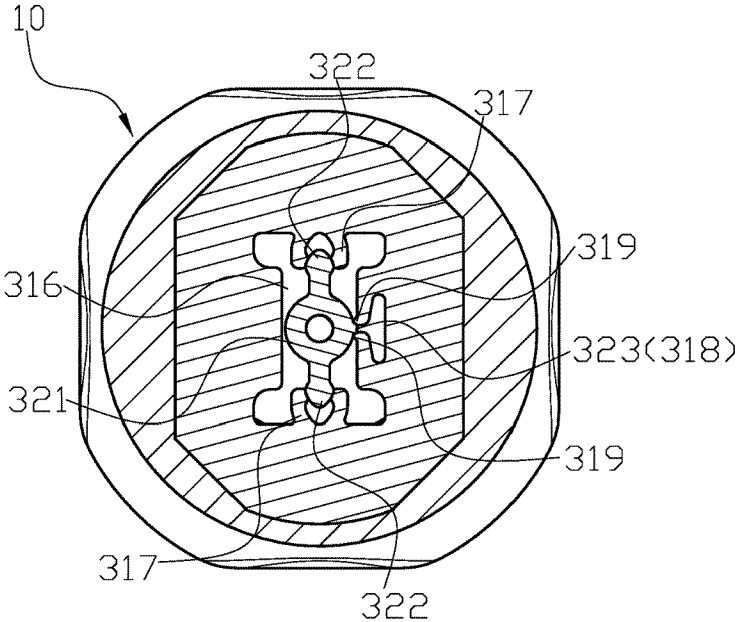
FIG. 6 is a sectional view along A-A of FIG. 5.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 7, the present invention provides a ratchet screwdriver, which comprises a handle (10), a shaft (20) and a ratchet switch device (30). The handle (10) has a passage (101) axially penetrating through a front end thereof, and a mounting member (11) is mounted on an outer periphery of the front end of the handle (10). Furthermore, a housing slot (102) formed inside a rear portion of the handle (10) is configured to receive the ratchet switch device (30). The shaft (20) is made of metal, and an insulated plastic (21) covers around an outer periphery of the shaft (20) to allow a metallic function end (22) of the shaft (20) to protrude from a front end of the plastic (21). Also, an insertion end (23) is connected to a rear end of the shaft (20), and a body of the shaft (20) further has a first peripheral groove (24) which is configured to allow the mounting member (11) to engage therewith after the shaft (20) is inserted into the handle (10) through the passage (101). The ratchet switch device (30) comprises a base (31), a switch button (32), a driving piece (33), a positioning member (34), two engaging blocks (35), two springs (36), a ratchet (37) and a locating piece (38). The base (31) has a rear wall (311), and two opposite sidewalls (312) respectively protrude from two opposite edges of the rear wall (311). The two sidewalls (312) are separated to form a housing chamber (314), and each of an upper end and a lower end thereof has an evading channel (313) formed between the two sidewalls (312), and a front end of the housing chamber (313) has a first opening.

Two first engaging portions (315) are respectively formed on the two sidewalls (312) at corresponding positions. Moreover, a central portion of the rear wall (311) of the base (31) has a second opening (316) which is communicated with the housing chamber (314). Each of an upper end and a lower end of the second opening (316) are respectively connected to an elastic first clamping piece (317), and a lateral edge of the second opening (316) comprises a locating notch (318). Furthermore, two blocking edges (319) respectively protrude from two lateral edges of the locating notch (318). The switch button (32) borne against a rear end of the rear wall (311) of the base (31) has a protruding column (321) penetrating through the second opening (316) of the base (31). Two clamping blocks (322) respectively protrude from an upper edge and a lower edge of the protruding column (321) toward respective first clamping pieces (317). In addition, an outer periphery of the protruding column (321) has a positioning piece (323) which is located inside the locating notch (318) of the base (31). The driving piece (33) configured to be received in the housing chamber (314) of the base (31) has two pressing rods (331) protruding from a front surface thereof, and the switch button (32) is connected to the driving piece (33) through the protruding column (321). The positioning member (34) has a bottom plate (341), and two lateral plates (342) are respectively connected to two opposite lateral edges of the bottom plate (341). Two blocking pieces (343) are respectively formed at an upper edge and a lower edge of the bottom plate (341), and a central hole penetrates through a central portion of the bottom plate (341). Two axle holes (345) are respectively formed on an upper portion and a lower portion of the bottom plate (341), and two slot holes (346) respectively formed adjacent to the two axle holes (345) are respectively extended to the two blocking pieces (343). Each of the two engaging blocks (35) has a row of engaging teeth (351), and the two engaging teeth (351) are located facing to each other. A supporting axle (352) protrudes from a rear end of the engaging block (35), and the two supporting axles (352) are configured to insert into the two axle holes (345) of the positioning member (34) respectively. Each of the two springs (36) is formed between the blocking piece (343) and the engaging block (35). The ratchet (37) has a peripheral ratchet teeth (371) disposed on an outer periphery thereof, and a locating slot (372) formed at a front end of the ratchet (37) is configured to receive the insertion end (23) of the shaft (20). A protruding piece (373) having a second peripheral groove and protruding from a rear end of the ratchet (37) is configured to penetrate through the central hole (344) of the positioning member (34), and a second clamping piece is configured to engage with the second peripheral groove of the protruding piece (373) to secure the ratchet (37) with the positioning member (34). Thus, an assembly of the positioning member (34), the engaging blocks (35), the springs (36) and the ratchet (37) is configured to be positioned into the housing chamber (314) of the base (31) through the first opening, and the two pressing rods (331) of the driving piece (33) respectively penetrate through the two slot holes (346) of the positioning member (34) to align with the two engaging blocks (35). The locating piece (38) has a through hole (381) formed at a central portion thereof, and each of two lateral walls of the locating piece (38) comprises a second engaging portion (382). The through hole (381) is configured to be penetrated by the ratchet (37), and with the evading channels (313), the locating piece (38) is configured to be received in the housing chamber (314) of the base (31). Moreover, since the two first engaging portions (315) of the base (31) are configured to respectively engage with the two second engaging portions (382), the locating piece (38) is configured to be firmly secured inside the base (31). Thus, an assembly of the base (31), the switch button (32), the driving piece (33), the positioning member (34), the engaging blocks (35), the springs (36), the ratchet (37) and the locating piece (38) is configured to be positioned into the housing slot (102) through a rear end of the handle (10), and the locating slot (372) of the ratchet (37) is configured to receive the insertion end (23) of the shaft (20).

In one embodiment, a rear end of the base (31) has a recessed area which is configured to receive the switch button (32).

In another embodiment, the first engaging portions (315) of the base (31) and the second engaging portions (382) of the locating piece (38) are engaged as a form of male fastener and female fastener.

In still another embodiment, at least one sidewall (312) of the base (31) comprises a locking unit such as a screw which is configured to screw in the lateral plate (342) of the positioning member (34).

Figure 9:
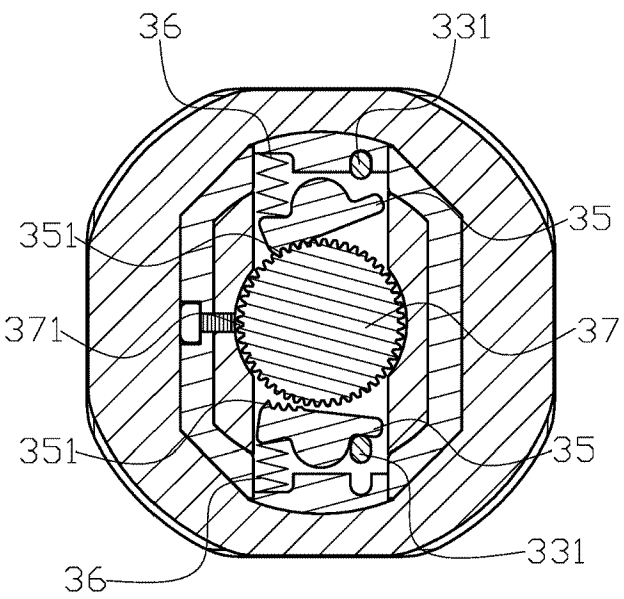
FIG. 9 is a schematic view illustrating an engaging block at a first side of a central hole of a positioning member is engaged with a ratchet of the ratchet screwdriver in the present invention.
Figure 8:
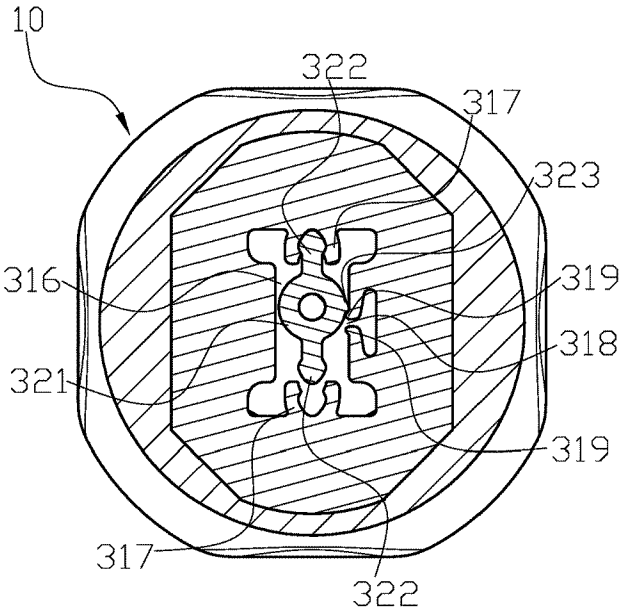
FIG. 8 is a schematic view illustrating a switch button of the ratchet screwdriver in the present invention is pushed toward a first direction.
Figure 11:
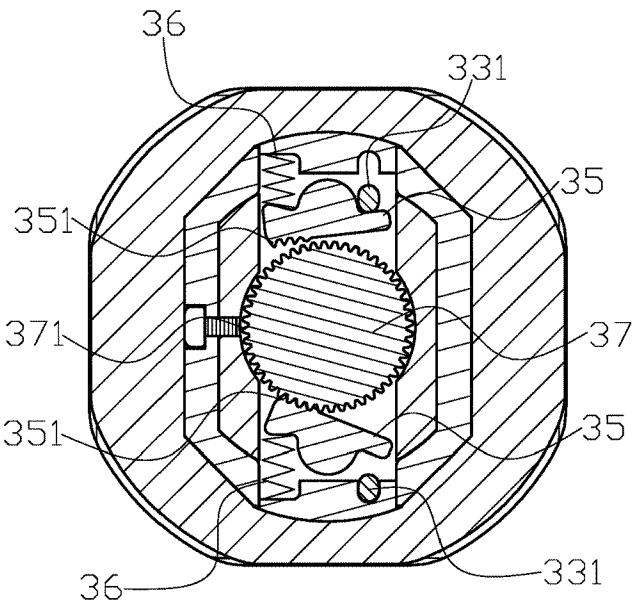
FIG. 11 is a schematic view illustrating an engaging block at a second side of the central hole of the positioning member is engaged with the ratchet of the ratchet screwdriver in the present invention.
Figure 10:
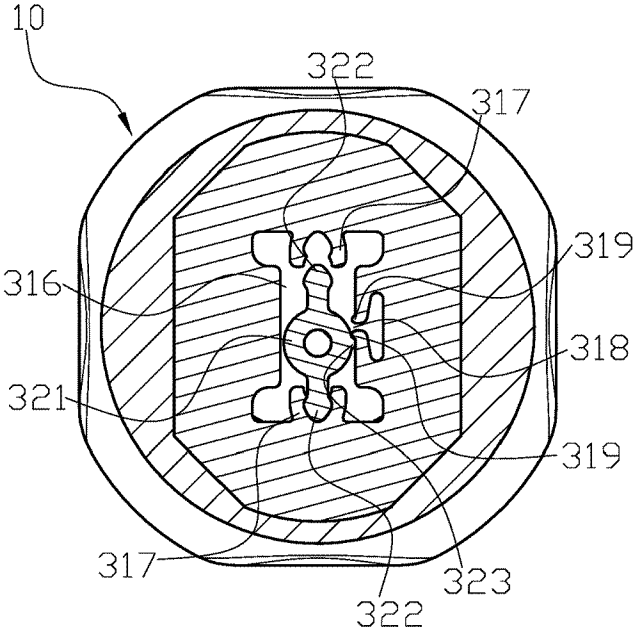
FIG. 10 is a schematic view illustrating the switch button of the ratchet screwdriver in the present invention is pushed toward a second direction.

In actual application, when the mounting member (11) of the handle (10) is at an unlocking position, a user can change different tools inserted into the function end (22) of the shaft (20), and the insulated plastic (21) covering around the shaft (20) is configured to achieve operational safety. When the switch button (32) is pushed toward a first direction (as shown in FIG. 8 or FIG. 10), the positioning piece (323) of the switch button (32) is detached from the locating notch (318) and passes through the blocking edge (319) located at a path of the first direction such that the clamping block (322) of the switch button (32) is configured to be firmly clamped by the first clamping piece (317) of the base (31) at the first direction. Thus, the pressing rod (331) at the first direction is configured to move away from the engaging block (35) at the first direction, and since the spring (36) is borne against the engaging block (35), the engaging teeth (351) of the engaging block (35) is configured to engage with the ratchet (371) of the ratchet (37). Thus, the pressing rod (331) at a second direction which is opposite direction of the first direction is configured to bear against the engaging block (35) at the second direction to move the engaging teeth (351) away from the ratchet teeth (371) of the ratchet (37) (as shown in FIG. 9 or FIG. 11). As a result, the handle (10) is configured to not drive the shaft (20) when rotated in a reversed-working direction.

Comparing with conventional ratchet screwdriver, the present invention is advantageous because: (i) the shaft (20) of the ratchet screwdriver can independently rotate relative to the handle (10) in the reversed-working direction such that a user has no need to repeatedly detach the ratchet screwdriver from a screw or re-hold the handle (10) when operating, which is more convenient and labor-saving; and (ii) the ratchet switch device (30) simplifies the structure of the ratchet screwdriver, wherein the switch button (32) can directly control the pressing rods (331) of the driving piece (33) to press the engaging blocks (35) thereby improving the efficiency of momentum transfer and the accuracy of operation.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ratchet screwdriver comprising:

a handle having a passage axially penetrating through a front end thereof, and a mounting member mounted on an outer periphery of the front end of the handle, and a housing slot formed inside a rear portion of the handle;

a shaft comprising a function end and an insertion end respectively formed at a front end and a rear end thereof, and a body of the shaft having a first periphery groove which is configured to allow the mounting member to engage therewith after the shaft inserted into the handle through the passage; and a ratchet switch device, which is received in the housing slot of the handle, comprising a base, a switch button, a driving piece, a positioning member, two engaging blocks, two springs, a ratchet and a locating piece, wherein the base has a rear wall, and two opposite sidewalls respectively protrude from two opposite edges of the rear wall, and the two sidewalls are separated to form a housing chamber, and each of an upper end and a lower end thereof has an evading channel formed between the two sidewalls, and a front end of the housing chamber has a first opening, and two first engaging portions are respectively formed on the two sidewalls at corresponding positions; a central portion of the rear wall of the base has a second opening which is communicated with the housing chamber, and each of an upper end and a lower end of the second opening are respectively connected to an elastic first clamping piece, and a lateral edge of the second opening comprises a locating notch, and two blocking edges respectively protrude from two lateral edges of the locating notch; wherein the switch button borne against a rear end of the rear wall of the base has a protruding column penetrating through the second opening of the base, and two clamping blocks respectively protrude from an upper edge and a lower edge of the protruding column toward respective first clamping pieces, and an outer periphery of the protruding column has a positioning piece which is located inside the locating notch of the base; wherein the driving piece configured to be received in the housing chamber of the base has two pressing rods protruding from a front surface thereof, and the switch button is connected to the driving piece through the protruding column; wherein the positioning member has a bottom plate, and two lateral plates are respectively connected to two opposite lateral edges of the bottom plate, and two blocking pieces are respectively formed at an upper edge and a lower edge of the bottom plate, and a central hole penetrates through a central portion of the bottom plate, and two axle holes are respectively formed on an upper portion and a lower portion of the bottom plate, and two slot holes respectively formed adjacent to the two axle holes are respectively extended to the two blocking pieces; wherein each of the two engaging blocks has a row of engaging teeth, and the two engaging teeth are located facing to each other, and a supporting axle protrudes from a rear end of the engaging block, and the two supporting axles are configured to insert into the two axle holes of the positioning member respectively; wherein each of the two springs is formed between respective blocking piece and the engaging block; wherein the ratchet has a peripheral ratchet teeth disposed on an outer periphery thereof, and a locating slot formed at a front end of the ratchet is configured to receive the insertion end of the shaft, and a protruding piece having a second peripheral groove and protruding from a rear end of the ratchet is configured to penetrate through the central hole of the positioning member, and a second clamping piece is configured to engage with the second peripheral groove of the protruding piece to secure the ratchet with the positioning member; wherein an assembly of the positioning member, the engaging blocks, the springs and the ratchet is configured to be positioned into the housing chamber of the base through the first opening, and the two pressing rods of the driving piece respectively penetrate through the two slot holes of the positioning member to respectively align with the two engaging blocks; wherein the locating piece has a through hole formed at a central portion thereof, and each of two lateral walls of the locating piece comprises a second engaging portion, and the through hole is configured to be penetrated by the ratchet, and with the evading channels, the locating piece is configured to be received in the housing chamber of the base, and the two first engaging portions of the base are configured to respectively engage with the two second engaging portions such that the locating piece is configured to be firmly secured inside the base; and wherein an assembly of the base, the switch button, the driving piece, the positioning member, the engaging blocks, the springs, the ratchet and the locating piece is configured to be positioned into the housing slot through a rear end of the handle, and the locating slot of the ratchet is configured to receive the insertion end of the shaft.

2. The ratchet screwdriver of claim 1, wherein the shaft is made of metal, and an insulated plastic covers around an outer periphery of the shaft to allow a metallic function end of the shaft to protrude from a front end of the plastic.

3. The ratchet screwdriver of claim 1, wherein a rear end of the base has a recessed area which is configured to receive the switch button.

4. The ratchet screwdriver of claim 1, wherein the first engaging portions of the base and the second engaging portions of the locating piece are engaged as a form of male fastener and female fastener.

5. The ratchet screwdriver of claim 1, wherein at least one sidewall of the base comprises a locking unit which is configured to screw in the lateral plate of the positioning member.

6. The ratchet screwdriver of claim 5, wherein the locking unit is a screw.

* * * * *